United States Patent [19]

Kurokawa

[11] 4,278,343

[45] Jul. 14, 1981

[54] INVERSION DEVELOPING METHOD FOR ELECTROPHOTOGRAPHY AND RELEVANT APPARATUSES

[75] Inventor: Junji Kurokawa, Tokyo, Japan

[73] Assignee: Ricoh Co., Ltd., Tokyo, Japan

[21] Appl. No.: 3,197

[22] Filed: Jan. 15, 1979

Related U.S. Application Data

[63] Continuation of Ser. No. 788,663, Apr. 18, 1977, abandoned.

[30] Foreign Application Priority Data

Apr. 22, 1976 [JP] Japan ..... 51-46010
Apr. 22, 1976 [JP] Japan ..... 51-46011

[51] Int. Cl.[3] ..... G03G 15/10
[52] U.S. Cl. ..... 355/10; 118/662; 355/77; 430/103; 430/117
[58] Field of Search ..... 355/3 DD, 10, 77; 96/1 R, 1 SD, 1 LY; 427/15-18; 118/647-650, 657, 658, DIG. 23, 662; 430/103, 117-119

[56] References Cited

U.S. PATENT DOCUMENTS

| | | | |
|---|---|---|---|
| 3,176,652 | 4/1965 | Mott et al. | 118/658 |
| 3,655,419 | 4/1972 | Tamai et al. | 355/10 X |
| 3,815,989 | 6/1974 | Davis et al. | 118/647 X |
| 3,888,666 | 6/1975 | Matsumoto | 96/1 LY X |
| 3,914,045 | 10/1975 | Namiki et al. | 355/3 DD |
| 3,941,469 | 3/1976 | Okamoto | 355/3 DD |
| 4,006,709 | 2/1977 | Miyakawa et al. | 427/15 X |
| 4,025,184 | 5/1974 | Mochizuki | 118/DIG. 23 |

*Primary Examiner*—R. L. Moses
*Attorney, Agent, or Firm*—Blanchard, Flynn, Theil, Boutell & Tanis

[57] ABSTRACT

The present invention provides a developing method for electrophotography which is developed to perform the development by electrically insulating the developing electrode from the support of the photosensitive material, together with apparatuses suitable for practicing said method. This developing method is applicable to both the wet inversion development and the magnetic brush inversion development, and it produces a negative-positive image having a satisfactory reproducibility particularly with respect to the solid image area thereof.

3 Claims, 12 Drawing Figures

INVERSION DEVELOPING METHOD FOR ELECTROPHOTOGRAPHY AND RELEVANT APPARATUSES

This is a continuation of application Ser. No. 788,663 filed Apr. 18, 1977, now abandoned.

BACKGROUND OF THE INVENTION (a) Field of the Invention

The present invention relates to an inversion developing method for electrophotography as well as apparatuses relevant thereto. To be precise, it relates to a wet inversion developing process and a magnetic brush inversion developing process for obtaining an inversion-developed positive image through negative projection applied to an electrophotographic sensitive material from a microfilm, an optical fiber memory tube or the like, as well as apparatuses ideal for practicing these processes.

(b) Description of the Prior Art

In the field of electrophotography, it has so far been considered very difficult to obtain an image having a mild edge effect and a satisfactory gradation according to the so-called 'inversion developing method' for making the toner adhere to the non-charged portions of the surface of the photosensitive material. This difficulty is ascribable to the fact that, in the conventional electrophotographic inversion developing method, the apparatus employed has been one which is intrinsically suitable for positive-positive development, and the negative-positive development has been conducted by merely changing the charged polarity of the toner.

It is admittedly known that, according to the magnetic brush inversion developing process, iron powder constituting the carrier acts as a developing electrode whereby there is obtained an image free of edge effect and showing a satisfactory reproducibility with respect to the solid image area in postive-positive development. However, when negative-positive development is conducted by changing the polarity of toner to the same polarity as that of the electric charge on the photosensitive material by friction with iron powder, there is apt to take place such undesirable phenomena that (1) the carrier, i.e., iron powder, mainly adheres to the non-image area (to wit, the area where the charge remains) of the photosensitive material and (2) the toner scarcely adheres to the image area (to wit, the noncharged area). The reason is that, inasmuch as both the developing sleeve and the base of the photosensitive material are earthed, the coulomb's force of the negative charge on the non-image area of the photosensitive material and the inductive charge of the carrier overcomes the magnetic force of the magnet working on the carrier, whereby the quantity of carrier adhering to the non-image area becomes relatively great, while the quantity of toner moving toward the image area along the electric field between the non-image area of the photosensitive material and the developing sleeve becomes to be relatively little.

In order to obtain a negative-positive image through the wet inversion developing process, it is usual to adopt the technique of increasing the bias voltage at the time of developing (to be more precise, imparting a voltage sufficient to overcome the maximum potential of the photosensitive material to the developing electrode). On this occasion, for the bias voltage, a means of utilizing an external power source such as disclosed in Japanese Patent Publication No. 7104/1958, a means of introducing the primary charge current into the developing electrode through ballista, etc. are usually employed.

In the case of the magnetic brush inversion developing process, a means of imparting the bias voltage to the developing sleeve, that is, a means of negatively charging the developing sleeve by the use of an external power source and minimizing the potential gradient between the developing sleeve and the nonimage area of the photosensitive material, thereby preventing adhesion of the carrier to the non-image area, is usually adopted.

However, these conventional processes employing particular devices such as external power source have a drawback that the developing apparatus per se comes to be complicated. Besides, the magnetic brush inversion developing process has also a drawback that, inasmuch as the carrier which is supposed to be positively charged due to friction with the toner is used upon charging negatively, there is a fear of deterioration of the developer, and the photosensitive material is apt to give rise to partial dielectric breakdown or leak through the carrier, resulting in a failure to obtain a satisfactory negative-positive image. Further, although it is generally believed that the toner contributes to improvement of the reproducibility of the half-tone corresponding to the potential gradient between the carrier and the image area of photosensitive material, the result of actual experiments verifies that it is in fact impossible to obtain a satisfactory inversion image by this process.

SUMMARY OF THE INVENTION

The object of the present invention is to provide an inversion developing method which eliminates the foregoing defects of the prior art and always provides a clear-cut inversion image (to wit, negative-positive image) with little edge effect, along with apparatuses ideal for practicing said method. The terms 'inversion developing method' herein means the wet inversion developing process and the magnetic brush inversion developing process.

The present invention relates to an inversion developing method for electrophotography, which is characterized in that the development is performed by electrically insulating the developing electrode from the support of the photosensitive material. To be concrete, the development in the present invention is carried out by applying an electrophotographic copying process employing a means for effecting inversion development of an electrostatic latent image obtained by charging an electrophotographic sensitive material by corona discharge and exposing it through a negative original, by the use of a toner having the same polarity as that of the charge on said photosensitive material.

The apparatus ideal for practicing the present invention is an inversion developing apparatus equipped with at least a charging device, an exposing device and a developing device disposed around or near the electrophotographic sensitive material, wherein the developing electrode of said developing device is electrically insulated from the support of said sensitive material and also is disposed close to said sensitive material so as to cause to exist an inductive potential Vf on the developing electrode.

BRIEF DESCRIPTION OF THE DRAWINGS

FIGS. 1 through 7 of the appended drawings are illustrative of an apparatus applicable to the wet inversion developing process in the method of the present invention, in which FIG. 1 is a schematic diagram of said apparatus, FIG. 2 is a diagram illustrating the equivalent circuit, FIG. 3 is a diagram illustrating the state of a squeegee roller as disposed close to the surface of a photosensitive material, FIGS. 4, 5 and 6 show 3 examples illustrative of the relation between a squeegee roller and a photosensitive material as being electrically insulated, and FIG. 7 is a side view of a blade-shaped squeegee member. In the drawings, the reference numeral 1 denotes a photosensitive material, 2 denotes a charging device, 3 denotes an exposing section, 4 denotes a developing section, 5 denotes a toner, 6 denotes a vessel, 7 denotes a developing electrode, 8 denotes a squeegee roller, 8' denotes a blade-shaped squeegee member, 9 denotes a transfer device, and 10 denotes a transfer material.

FIG. 8 is a diagram illustrating the movement of the toner 5 in said magnetic brush inversion developing process, FIG. 9 is illustrative of the mode of forming an inversion image directly on the photosensitive material, and FIG. 10 is a schematic diagram of an apparatus applicable to the magnetic brush inversion developing process.

Figure 1:
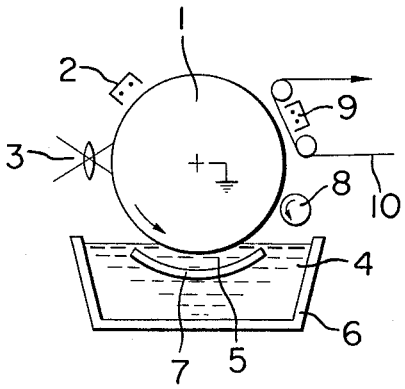

In the drawings, the reference numeral 11 denotes a developing sleeve, 12 denotes the carrier, and the developing sleeve 11 constitute a developing electrode. 13 denotes the base (support) of a photosensitive material, 14 denotes the photosensitive layer of a photosensitive material, 15 denotes a magnet, 16 denotes a charge eliminator, 17 denotes a cleaning device, 18 denotes a heater (thermal fixing device), 19 denotes a belt conveyor, and 20 denotes an external power source.

DETAILED DESCRIPTION OF THE INVENTION

As described in the foregoing, the inversion developing methods for electrophotography according to the present invention can be classified broadly into the wet inversion developing process and the magnetic brush inversion developing process.

Now, the wet inversion developing process according to the present invention will be first explained with reference to FIGS. 1 through 7. According to the process of the present invention, unlike the conventional wet inversion developing process, the wet inversion development is performed while the developing electrode 7 disposed close to the surface of the photosensitive material is held in the state of being electrically insulated from the support (base) of the photosensitive material 1. By virtue of this arrangement, a negative potential comes into existence on the developing electrode 7 which is spaced from the non-image area (to wit, the negatively charged area of the photosensitive material) due to electrostatic induction (this effect is called the 'float-bias effect'), and there is generated an electric field between the electrode 7 and the image area so that the toner 5 is pushed away in the direction of the photosensitive material 1, whereby a satisfactory inversion image can to be formed.

Generally speaking, at the time of negative-positive development, the electrostatic charge on the photosensitive material is great (that is, after exposure through a negative film, an electrostatic charge is always left on the non-image area). Accordingly, it is likely that the potential on the developing electrode 7 by electrostatic induction, i.e., inductive potential Vf, is high in proportion thereto, whereby the same effect as in the case of employing an external power source can be obtained. As to the adhesion of the toner 5, it can be adjusted by regulating the surface potential of the photosensitive material 1.

In order to practice the wet inversion developing process according to the present invention, it suffices to follow the procedure that the surface of the photosensitive material 1 is charged positively or negatively through corona discharge or other means, the thus charged photosensitive material 1 is exposed to light through a negative original thereby to form an electrostatic latent image (on this occasion, the charged area becomes the non-image area), the thus exposed photosensitive material 1 is moved to the developing section to effect development by the use of the toner 5 (a liquid developer) charged to have the same polarity as that of the electrostatic charge on the surface of said photosensitive material 1, the excess developer is removed thereafter, and the resulting toner image is transferred onto a transfer material 7 such as an ordinary paper. The transferred toner image is then fixed by a known means such as thermal fixing, pressure-fixing, etc.

The photosensitive material 1 for use in the present invention is ordinarily of drum-shape, and the developing electrode, the developer, etc. are quite the same as the conventional ones. However, in the case of a photosensitive material prepared by employing an organic photoconductive substance, it is impossible to realize a surface potential as high as in the case of photosensitive materials employing inorganic photoconductive substances like selenium, cadmium sulfide, etc. and accordingly, the concentration of the image tends to be lower to some degree. The appropriate surface potential for the photosensitive material 1 is in the range of 800–1200 V. And, as to the distance between the surface of photosensitive material 1 and the developing electrode 7, though there is no need to specify it provided that it is sufficient for giving rise to an inductive potential Vf on the developing electrode 7, the appropriate distance is in the range of 1–3 mm or thereabouts.

As an ideal apparatus for use in practicing the above described wet inversion developing process, there can be exemplified an apparatus illustrated in FIG. 1 which is constructed so that around a drum-shaped electrophotographic sensitive material 1 (e.g., a drum-shaped photosensitive material prepared by depositing selenium through vacuum evaporation on an aluminum base to the extent of about 50$\mu$ in thickness) are provided a charging device 2 (whereby said selenium-deposited photosensitive material is to be positively charged to the extent of about 1000 V), an exposing section 3, a wet developing device (or wet developing section) 4, a roller-shaped or blade-shaped squeegee member 8 (or 8') and a transfer device 9. The developing electrode 7 of said developing device 4 is electrically insulated from the support of the photosensitive material 1, said developing electrode 7 is disposed close to the surface of the photosensitive material 1 at a distance sufficient for giving rise to an inductive potential Vf, and a squeegee member 8 (or 8') and the base (support) of the photosensitive material 1 are held in the state of being electrically insulated from each other. In this connection, the wet developing device 4 consists of a vessel 6 containing the toner 5 which is charged to be of the same polarity as that of the electrostatic charge on the surface of the photosensitive material 1 (the toner herein is one charged positively in common with the electrostatic charge on the selenium-deposited photosensitive material) and is provided with the developing electrode 7 installed in said vessel.

Figure 2:
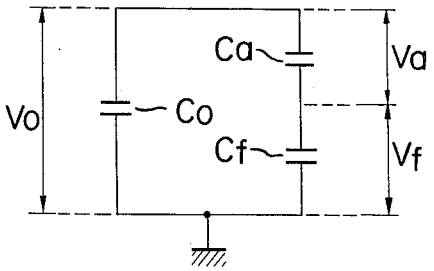

In the case of operating an apparatus satisfying the foregoing requirements, when the average surface potential of the photosensitive material 1 after forming an electrostatic latent image through a negative film is expressed by Vo, the electrostatic capacity of the photosensitive material 1 is expressed by Co, the electrostatic capacity in between the photosensitive material 1 and the developing electrode 7 is expressed by Ca, and the electrostatic capacity in between the developing electrode 7 and the earth is expressed by Cf, there arises a potential Vf expressed by the following equation, on the developing electrode 7 by electrostatic induction through the equivalent circuit illustrated in FIG. 2.

$$Vf = \frac{Ca}{Ca + Cf} Vo$$

This equation infers that use of a construction and a developing apparatus wherein Ca is large and Cf is small will provide a considerably large Vf, whereby the potential gradient relative to the non-image area of the surface of the photosensitive material can be lessened and the adhesion of the toner is effected in proportion to the potential gradient relative to the image area thereof, resulting in a positive image satisfactory in reproducibility with respect to the halftone. In this connection, Vf depends on the size of image area of the negative original; but in the case of general negative films, it is less than $\frac{1}{3}$ because the image area covers less than $\frac{1}{3}$ of the total area of the negative original, and in the case of an original consisting mainly of drawings, it is usually less than 1/5.

The squeegee roller 8 disposed near the surface of photosensitive material 1 is devised to rotate in the opposite direction relative to the photosensitive material 1 (to wit, drum-shaped photosensitive material) so that it is useful for removing excess developer adhering to the photosensitive material. As set forth in the foregoing, this squeegee roller 8, like the developing electrode 7, is electrically insulated from the base (support) of the photosensitive material. If it were to be electrically connected with the base the photosensitive material, the toner image once formed on the photosensitive material would adhere to the squeegee roller 8 and the image would be disordered, resulting in failure in obtaining a copied image of good quality.

Figure 4:
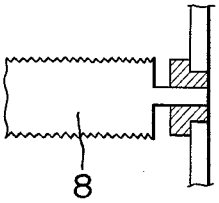
Figure 5:
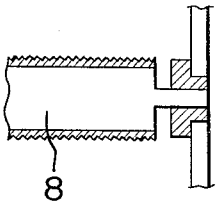
Figure 6:
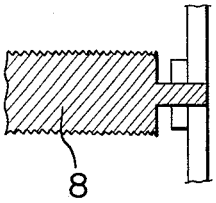

As to the particulars of this squeegee roller 8, there are relevent descriptions in Japenese Patent Open No. 5025/1976, and the applicable squeegee roller includes (a) one composed of a metallic roller with a roughened surface which is insulated by means of a bearing such as illustrated in FIG. 4, (b) one composed of a metallic roller having its surface processed with resin and being insulated by means of a bearing such as illustrated in FIG. 5, (c) one composed of a roller consisting entirely of resin (to wit, electrically insulating material) such as illustrated in FIG. 6, etc.

Figure 3:
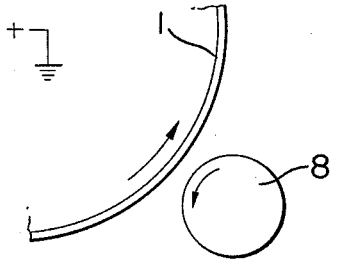
Figure 7:
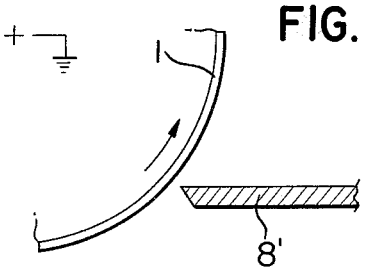

FIG. 7 illustrates a blade (to wit, blade-shaped squeegee member 8') which can be substituted for the squeegee roller 8 illustrated in FIG. 3, and this blade consists of the same material as that for the squeegee roller 8. It goes without saying that this blade should also be electrically insulated from the base (support) of the photosensitive material.

According to the apparatus described above, it is possible to obtain a multiplicity of clear-cut copies continuously. Besides, in this apparatus, a cleaning device (not shown in the drawings) is appropriately disposed between the charging device 2 and the transfer device 9.

Next, the magnetic brush inversion developing process will be explained hereunder with reference to FIGS. 8 through 12.

The magnetic brush inversion development according to the present invention is characterized in that the developing sleeve 11 is electrically insulated from the base 13 of the photosensitive material so as to prevent adhesion of the carrier onto the surface of the photosensitive material, thereby obtaining a negative-positive image satisfactory in reproducibility with respect to the solid image area. The carrier 12 is an iron powder, powder of magnetic substance, etc. which are useful for the conventional magnetic brush developing process.

Figure 8:
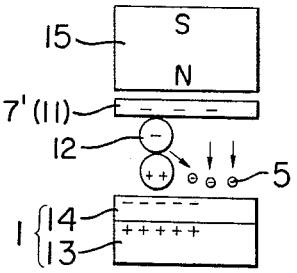
FIGS. 8 through 10 relate to the magnetic brush inversion developing process in the method of the present invention.

Referring to FIG. 8, by virtue of the electrical insulation of the developing sleeve 11 from the base 13 of photosensitive material 1, on the carrier particle 12 located close to the non-image area of the surface of the photosensitive material there appears a positive charge relative to the negative charge of the photosensitive material (to wit, photosensitive layer 14) due to electrostatic induction, while on the carrier particle 12 located remote from said surface and the developing sleeve 11 there remains a negative charge. Accordingly, due to electrostatic induction, the carrier particle 12 close to the surface of the photosensitive material adheres to the non-image area, while because of the negative charge remaining on the carrier particle 12 remote from the non-image area (to wit, the negatively charged area of the photosensitive material) and the developing sleeve 11 due to electrostatic induction, adhesion of the carrier particles 12 as a whole in little.

Further, like the case of the afore described wet inversion developing process, because of the developing sleeve 11 and the carrier particle 12 adjacent thereto are negatively charged (that is, floatbias effect) and an electric field is generated between the image area and the developing sleeve 11, the toner 5 is pushed away in the direction of the photosensitive material 1, whereby a satisfactory inversion image comes to be formed. Adhesion of the carrier particles 12 is likely to be considerably prevented by enhancing the magnetic force of the magnet 15 and/or adjusting the surface potential of the photosensitive material.

Figure 11:
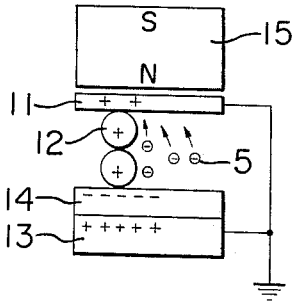
FIG. 11 PRIOR ART
FIGS. 11 and 12 are diagrams illustrating the conventional magnetic brush inversion developing process.

In this respect, when both the developing sleeve 11 and the base of photosensitive material 13 are being earthed as illustrated in FIG. 11, coulomb's force of the negative charge on the non-image area (to wit, the negatively charged area) of the photosensitive material 1 and the inductive charge of the carrier particles 12 overcomes the magnetic force of the magnet 15 working on the carrier particles 12, whereby the quantity of carrier particles 12 adhering to the non-image area comes to be relatively great, while the quantity of the toner 5 moving toward the image area along the electric field in between the non-image area of the photosensitive material 1 and the developing sleeve 11 (as well as the carrier particles 12) tends to be relatively little. Therefore, according to the mode illustrated in FIG. 11, it is impossible to obtain a satisfactory negative-positive image through inversion development.

Figure 12:
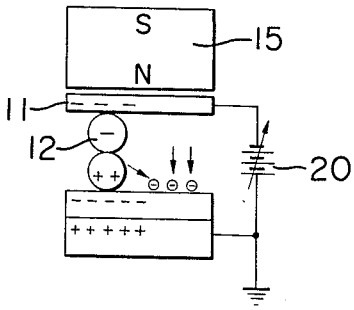
FIG. 12 PRIOR ART

What has been discussed with reference to FIG. 11 applies to the mode illustrated in FIG. 12, too, which is devised to impart a bias voltage to the developing sleeve 11. That is, when the developing sleeve 11 is negatively charged by means of an external power source 20 and the potential gradient between said sleeve 11 and the non-image area of photosensitive material is lessened, adhesion of the carrier particles 12 onto the non-image area can admittedly be prevented, but, as set forth in the foregoing, in the case where the carrier particles 12 is used upon charging it negatively, there is brought about deterioration of the developer, dielectric breakdown of the photosensitive material, etc., resulting in failure in obtaining a satisfactory negative-positive image.

In order to practice the magnetic brush inversion developing process according to the present invention, it suffices to follow the procedure that an electrostatic latent image is first formed on the surface of the photosensitive material 1, the photosensitive material 1 with said latent image is sent in the developing section to effect development of the latent image by the use of the toner 5 charged to have the same polarity as that of electrostatic charge on the surface of said photosensitive material 1 through friction with the carrier particles 12 under the condition of electrically insulating the magnet 15 and the carrier particles 12 from the base of photosensitive material 13, and fixing of the thus developed image is performed thereafter.

As the photosensitive material for use in the present process, there can be cited an ordinary electrophotographic sensitive paper, a drum-shaped photosensitive material, etc. The developing electrode, toner, etc. to be applied are quite the same as the conventional ones. However, it is natural that the surface potential to be applied should vary with the kind of the photosensitive material; the appropriate surface potential is in the range of 650–800 V in the case of photosensitive materials employing selenium and organic photoconductive substances and is in the range of 400–550 V in the case of photosensitive materials employing zinc oxide. In both cases, deviation from the foregoing range is undesirable because application of a surface potential less than the lower limit will entail insufficient concentration of image, while application of a surface potential exceeding the upper limit will entail adhesion of the carrier onto the image.

Figure 9:
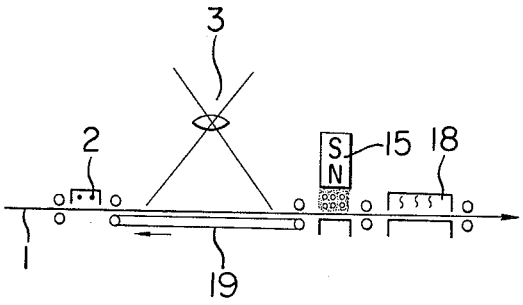
Figure 10:
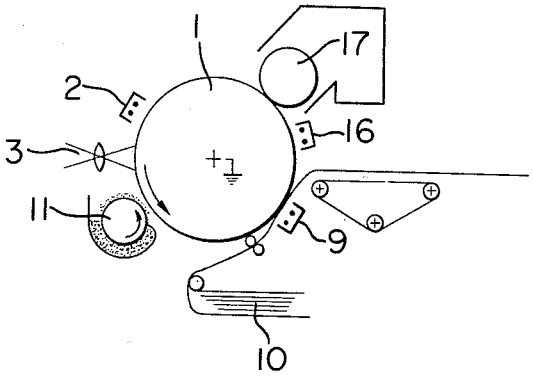

As an ideal apparatus for use in practicing the above described magnetic brush inversion developing process, there can be used an apparatus illustrated in FIG. 9 which is devised to form an inversion image directly on a zine oxide type photosensitive paper (to wit, an electrophotographic sensitive material 1) by the use of the so-called leader printer having a conveying means 19 and equipped with a charging devices 2, an exposing device 3 and a magnetic brush developng device, or an apparatus illustrated in FIG. 10 which is devised to form an inversion image once on a selenium type photosensitive material by the use of the so-called enlarger printer equipped with a charging device 2, an exposing device 3, a magnetic brush developing device and a transfer device 9 disposed around the photosensitive material 1 and then transfer the thus formed inversion image onto a transfer material 10 such as an ordinary paper, thereby obtaining an intended image, and other apparatuses. It goes without saying that, in these apparatuses, the developing sleeve 11 and the adjacent carrier particles 12 should be electrically insulated from the base of photosensitive material (to wit, the support of photosensitive material) 13. As to the way of electrically insulating as above, it will do to apply the same as previously described with respect to the wet inversion developing process.

As discussed hereinabove, the present invention renders it possible to obtain a satisfactory inversion image merely by electrically insulating the developing electrode from the base of the photosensitive material and therefore its effect in practical use is tremendous.

DESCRIPTION OF THE PREFERRED EMBODIMENTS

EXAMPLE 1

By employing a wet inversion developing apparatus such as illustrated in FIG. 1, a drum-shaped selenium type photosensitive material 1 uniformly positively charged to the extent of about 1000 V was exposed through a negative film in the exposing section 3 thereof. Subsequently, the thus exposed photosensitive material 1 was subjected to wet development employing a toner charged positively in the developing section 4, under the condition of being electrically insulated from the base of the photosensitive material. Next, after removing excess liquid developer by means of a squeegee roller 8 which was electrically insulated from the base of the photosensitive material, the toner image formed on the surface of photosensitive material was transferred to an ordinary paper. The resulting positive image was of good quality free of edge effect.

EXAMPLE 2

By employing a wet inversion developing apparatus such as illustrated in FIG. 1, a drum-shaped selenium type photosensitive material uniformly positively charged to the extent of about 1100 V was exposed through an expanded slit by applying a negative microfilm (having the image area accounting for about 30% of the whole film), and the thus exposed photosensitive material was then subjected to inversion development with positively charged toner.

On this occasion, when the developing electrode 7 (which was disposed at a distance of 1–1.5 mm from the surface of selenium type photosensitive material 1) and the base of photosensitive material were held in the state of being electrically insulated from each other, there appeared inductive potential Vf averaging 700 V on the developing electrode 7 during the development, and when the squeegee roller 8 (which was disposed at a distance of 0.05 mm from the surface of selenium type photosensitive material 1 and devised to rotate in a direction opposite to the direction of movement of the surface of said photosensitive material 1) and the base of photosensitive material were held in the state of being electrically insulated from each other and excess liquid developer was removed, there could be formed a satisfactory inversion toner image on the selenium type photosensitive material. Next, when the thus formed toner image was transferred onto an ordinary paper 10, there was obtained a negative-positive image having a satisfactory reproducibility particulary with respect to the solid image area.

EXAMPLE 3

By employing a magnetic brush inversion developing apparatus (to wit, leader printer) such as illustrated in FIG. 9, a zinc oxide type photosensitive material 1 as negatively charged to the extent of about 500 V uniformly was subjected to stationary exposure through a negative film in the exposing section 3, and the thus exposed photosensitive material was then sent to the developing section. When development of said photosensitive material was effected in this developing section by using a toner charged negatively through friction with the carrier particles (to wit, iron powder) while holding the magnet and the carrier particles (iron powder) in the state of being electrically insulated from the base of photosensitive material, there was obtained a negative-positive image of good quality free of edge effect. Besides, there was scarcely observed any adhesion of carrier particles (iron powder) to the photosensitive material 1.

EXAMPLE 4

By employing a magnetic brush inversion developing apparatus (to wit, enlarger printer) such as illustrated in FIG. 10, a selenium type photosensitive material 1 uniformly positively charged to the extent of about 800 V was exposed through an expanded slit by applying a negative microfilm (having the image area accounting for about 30% of the whole film), and the thus exposed photosensitive material was then subjected to inversion development with positively charged toner.

On this occasion, when the developing sleeve (as disposed at a distance of 2–4 mm from the surface of said selenium type photosensitive material and having a surface magnetic flux density of about 700 gauss) and the carrier particles (to wit, iron powder) were held in the state of being electrically insulated from the base of selenium type photosensitive material (the selenium deposited drum thereof was earthed), there appeared inductive potential Vf averaging 400 V on the developing sleeve during the development, and there could be formed a satisfactory inversion image free of adhesion of carrier on the selenium type photosensitive material 1. Next, when the thus formed inversion image was transferred onto an ordinary paper 10, there was obtained a negative-positive image having a satisfactory reproducibility particularly with respect to the solid image area.

What is claimed is:

1. In a method for forming a positive development image by developing an electrostatic latent negative image on the photosensitive layer of an electrophotographic element with a liquid developer whose toner particles have the same polarity as said negative image whereby the toner particles adhere to the non-negative image areas on said photosensitive layer, the improvement which comprises:

in the developing step, positioning a developing electrode in the liquid developer and in close proximity to the photosensitive layer of the electrophotographic element and maintaining said developing electrode electrically insulated from the base of the electrophotographic element so that a potential is induced on said developing electrode to create an electric field between said developing electrode and the non-negative image areas of said photosensitive layer effective to cause the toner particles to migrate to and adhere to said non-negative image areas in order to form the positive developed image thereon, then moving the photosensitive layer carrying the positive developed image thereon past a squeegee member which is electrically insulated from the base of the electrophotographic element and is electrically insulated from any source of electrical potential whereby to remove excess liquid developer from the photosensitive layer, and then transferring the toner image on the surface of the photosensitive layer to paper to form a positive developed image on the paper.

2. An electrophotographic apparatus for wet inversion development, comprising:

a rotatable drum-shaped electrophotographic element having a photosensitive layer and an electrically conductive base;

a charging device for charging the photosensitive layer of said element with an electrostatic charge;

an exposing device for negative imagewise exposing said electrostatically charged photosensitive layer to form an electrostatic latent negative image thereon;

a wet developing device comprising a developing electrode which is electrically insulated from the base of the electrophotographic element and is disposed close to said photosensitive layer so that a potential is induced on said developing electrode, said wet developing device also including a liquid developer disposed between and in contact with the developing electrode and said photosensitive layer, the toner particles of said liquid developer having the same polarity as the polarity of the charges defining said electrostatic latent negative image;

a squeegee located after said wet developing device and disposed for removing excess developer from said photosensitive layer, said squeegee being electrically insulated from the base of the electrophotographic element and being electrically insulated from any source of electrical potential;

a transfer device located after said squeegee for transferring the toner image formed on the surface of the photosensitive layer to a substrate to form a positive developed image on the substrate.

3. An apparatus according to claim 2 wherein said squeegee is a roller which rotates in the opposite direction to the direction of rotation of said drum-shaped electrophotographic element.

* * * * *